US006963711B2

(12) United States Patent
Tanaka et al.

(10) Patent No.: US 6,963,711 B2
(45) Date of Patent: Nov. 8, 2005

(54) DEVELOPING METHOD AND DEVELOPING DEVICE FOR ELECTROPHOTOGRAPHIC IMAGE, AND PRINTING DEVICE USING THE DEVELOPING DEVICE

(75) Inventors: Tomoaki Tanaka, Kawasaki (JP); Satoshi Takezawa, Kawasaki (JP); Yoshimichi Katagiri, Kawasaki (JP); Masae Nakamura, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 11 days.

(21) Appl. No.: 10/665,121

(22) Filed: Sep. 22, 2003

(65) Prior Publication Data

US 2005/0100811 A1 May 12, 2005

Related U.S. Application Data

(63) Continuation of application No. PCT/JP01/02242, filed on Mar. 21, 2001.

(51) Int. Cl.[7] ..... G03G 15/08
(52) U.S. Cl. ..... 399/258; 430/110.4
(58) Field of Search ..... 399/252, 255, 399/258; 430/110.4, 120

(56) References Cited

U.S. PATENT DOCUMENTS 4,930,438 A 6/1990 Demizu et al.
5,731,122 A 3/1998 Yoshida et al.

FOREIGN PATENT DOCUMENTS

EP 0 445 986 A1 9/1991
JP A 60-229057 11/1985
JP A 61-42672 3/1986
JP A 63-276064 11/1988
JP A 1-225961 9/1989
JP A 3-259161 11/1991
JP A 8-22138 1/1996
JP A 8-240925 9/1996
JP A 8-248668 9/1996
JP A 8-334968 12/1996
JP A 9-152767 6/1997
JP A 10-307464 11/1998

*Primary Examiner*—Arthur T. Grimley
*Assistant Examiner*—Ryan Gleitz
(74) *Attorney, Agent, or Firm*—Oliff & Berridge, PLC

(57) ABSTRACT

A developing device for electrophotographic image has a developing mechanism having a developer carrier for carrying a developer along a preset circulating route including a developing area and a developer restricting element for restricting the developer on the developer carrier, and a developer supply mechanism having a storing unit. The storing unit is filled with a start-up developer in the vicinity of the developer carrier and a replenishing developer remoter than the start-up developer from the developer carrier. The start-up developer and the replenishing developer have different grain sizes or grain size distributions. Further, a developing method for electrophotograhic image has the steps of using the start-up developer at an initial state of use of the developing mechanism, and using the replenishing developer differed in grain size or grain size distribution from the start-up developer after an end of the initial state of use of the developing mechanism.

6 Claims, 6 Drawing Sheets

○ : SUITABLE
△ : PROPER
× : IMPROPER

FINE POWDER AMOUNT OF REPLENISHING TONER WAS SET TO cnt.% ≦ 25.0% AND vol.% ≦ 5.0%

○ : SUITABLE
△ : PROPER

AVERAGE GRAIN SIZE OF REPLENISHING TONER WAS SET TO 7.5 ≦ vol.% ≦ 8.5.

DEVELOPING METHOD AND DEVELOPING DEVICE FOR ELECTROPHOTOGRAPHIC IMAGE, AND PRINTING DEVICE USING THE DEVELOPING DEVICE

CROSS REFERENCE TO RELATED APPLICATION

This is a Continuation of Application No. PCT/JP01/02242 filed on Mar. 21, 2001. The entire disclosure of the prior application is hereby incorporated by reference herein in its entirety.

BACKGROUND OF THE INVENTION

1. Field of the Invention

The present invention relates to an electrophotographic image forming technique and, more particularly, to a developing method and developing device for electrophotographic image, and a printing device using the developing device.

2. Description of the Related Art

An electrophotographic image forming method is an image forming method adapted in copying machines, laser printers, and the like. In this electrophotographic image forming method, generally, uniform static charges are preliminarily given onto a photoconductive insulator layer, and the photoconductive insulator layer is irradiated with a light image, thereby partially removing the static charges to form an electrostatic latent image. Further, a fine powder called a developer (toner) is adhered to the part having the residual static charges on the photoconductive insulator layer to visualize the latent image. The resulting toner image is then formed (developed) on and fixed to a recording sheet, thereby obtaining a printed matter.

The developing method (forming method) for electrophotographic image is roughly classified to a two-component developing method using a two-component developer formed of magnetic carrier and nonmagnetic or magnetic toner and a one-component developing method using a one-component developer formed of only magnetic or nonmagnetic toner. The one-component developing method is further classified to a magnetic one-component developing method using magnetic toner, and a nonmagnetic one-component developing method using nonmagnetic toner.

In this specification, the nonmagnetic one-component developing method using nonmagnetic one-component toner (developer) and such a nonmagnetic one-component developing toner will be mainly described. However, the present invention is never limited to such nonmagnetic one-component developing method and nonmagnetic one-component developing toner, and can be extensively applied to developing methods for electrophotographic image using various toners, and such toners for developing electrophotographic images.

A conventional electrophotographic image forming technique (image forming process) is described below.

One example of a conventional nonmagnetic one-component developing device is schematically shown in FIG. 1. Such a developing device is disclosed in detail, for example, in Japanese Unexamined Patent Publication (Kokai) No. 60-229057, Japanese Unexamined Patent Publication (Kokai) No. 61-42672 (corresponding U.S. Pat. No. 4,930,438), or the like.

As shown in FIG. 1, the conventional nonmagnetic one-component developing device (developing unit) 7 is provided with a storing means (toner tank, etc.) 1 for storing a developer (toner) 8; a developer supply mechanism (stirring paddle) 2 for conveying the toner along a circulating route; a developer carrier (developing roller, etc.) 3 for conveying the toner along a preset circulating route including a developing area; and a roller-like developer recovering means (recovery roller, etc.) 4 which is provided to make contact with the developing roller 3 and has a flexible material adhered to the surface part. Further, the developing unit is provided with a developer restricting element (restricting blade: toner restricting element) 5 for restricting the thickness of toner on the developing roller 3 and a photoconductive insulator (photosensitive drum, etc.) 6 for forming and holding an electrostatic latent image, which is arranged opposite to the developing roller 3 to be contactable thereto. The developing roller 3 is constituted so as to convey the toner supported on the developing roller 3 to the opposed photoconductive insulator 6 by rotation. The developing unit 7 having the toner tank 1, the stirring paddle 2, the developing roller 3, the recover roller 4 and the restricting blade 5 is replaced by a new one after printing (developing) a prescribed number of sheets.

The developing process is then described in detail in reference to FIG. 1.

The toner (developer) 8 is conveyed from the toner tank 1 onto the developing roller 3 via the stirring paddle 2.

The toner supplied onto the developing roller 3 reaches the restricting blade 5 by the rotation of the developing roller 3, and only a fixed amount guided depending on the clearance between the developing roller 3 and the restricting blade 5, the materials thereof or the like is supplied to the photosensitive drum 6. At this time, the toner is electrified to a desired charge by being strongly rubbed with the restricting blade 5 or receiving the charge injection of a potential applied, as occasion demands, to the developing roller 3 or restricting blade 5.

When the developing roller 3 is then opposed to the photosensitive drum 6, the toner on the developing roller 3 is transferred onto the photosensitive drum 6 according to the electrostatic latent image potential on the photosensitive drum 6 by use of an electric attractive force or repulsive force such as the potential (developing bias potential) applied to the developing roller 3, the electrified potential of the toner, or the electrostatic latent image potential formed on the photosensitive drum 6 as driving force to visualize the electrostatic latent image, whereby the developing is performed.

The toner which was not transferred to the photosensitive drum 6 in the developing by the developing roller 3 is removed by the potential difference (recovering bias potential) between the developing roller 3 and the recovery roller 4 or a mechanical friction (peeling force) when the developing roller 3 is further rotated and opposed to the recovery roller 4, and the electric history on the developing roller 3 is also erased.

As the toner, resin fine particles having average grain sizes of about 5 to 15 $\mu$m, which contain a natural or synthetic thermoplastic polymer resin (binder resin) having a weight average molecular weight of about several thousands to hundreds of thousands, a wax, a coloring agent, and, as occasion demands, a charge controlling agent or the like are generally used.

In the conventional developing unit, the toner is physically and electrostatically supplied from the recovery roller (reset roller) 4 to the developing roller 3 to perform a developing on the photosensitive drum 6, and the toner left on the developing roller 3 is then recovered by the recovery roller 4. In such a conventional developing unit, however, if the toner is still left on the developing roller 3 beyond recovery in the recovery of the residual toner on the developing roller 3 by the recovery roller 4, the left toner is repeatedly used again in the developing process, which leads to a printing failure or the filming or contamination of a functional member such as roller. The filming or contamination of the functional member consequently causes a reduction in life of the developing unit.

The developing roller 3, the recovery roller 4, and the restricting blade (toner restricting element) 5 are important parts which are repeatedly used for developing, and influence on electric characteristics such as carrying property of toner, frictional electrification amount, developing toner amount, and developing bias, and recovery bias potential. Therefore, these parts need to keep regularly stable physical and chemical characteristics during the drive of a printing device using the electrophotographic image forming method.

The disruption of the balance of these characteristics triggers a printing failure such as fog, fading, or after image. Therefore, in the electrophotographic image forming method using one-component developing method, for example, the need of replacing the developing unit arises when these members cannot keep desired characteristics because of the wear by repeated use or the like. The frequent replacement of the developing unit extremely disadvantageously brings about a rise of running cost of the printing device.

In an unused developing unit, on the other hand, each member shows physical and chemical characteristics derived from the constituting material of each member because it has not suffered a strong stress with toner yet. However, when this developing unit is used for printing, it suffers a strong physical stress with the toner.

Since the toner is mainly made up of a thermoplastic resin, as described above, and an energy-saved fixing has been strongly desired in recent years, the characteristics of the toner are becoming soft. Therefore, if the surface of the developing unit component is thinly filmed with the stressed toner just after the start of printing, the physical and chemical characteristics shown by each component are changed from the characteristic values derived from the constituting material to the values influenced by the thin filming with the toner. This change in physical property value, as a matter of course, inconveniently causes a change in printing characteristics.

As a means to cope with this problem, for example, it is adapted to subject a produced new developing unit to a test print of a fixed number of sheets, thereby thinly filming the surfaces of components with toner so that the physical and chemical characteristics shown by the components reach a steady state followed by shipping. However, since the printing of thousands sheets or more is often required in order to prevent the fluctuation of printing characteristics, the substantial life of the developing unit is shortened by the printing number of sheets in the test printing, and an increase in manufacturing cost further arises because the test printing involves a complicated work.

As another solution, it is also adapted to use a fragile material for each component, and successively peel, even if thinly filmed with toner, the thinly filmed outermost surface by the friction between members, thereby regularly exposing a fresh face to keep the physical and chemical characteristics peculiar to the components. However, this method involves the factor of shortening the replacing period of the developing unit, and cannot be said to be preferable.

Further, in a related art disclosed in Japanese Unexamined Patent Publication (Kokai) No. 63-276064, the difference between volume average grain size and number average grain size is minimized (a toner with minimized fine powder amount and sharp grain size distribution is regulated). This method is good for the effects to fog, low density, history after image and the like, but unsatisfactory in yield and cost. It further has the problem of reduction in electrification or fogging of background part that may be encountered when the fine powder amount is increased in continuous printing.

Further, a related art disclosed in Japanese Unexamined Patent Publication (Kokai) No. 8-22138 is effective for fog of background part, but has problems of lowered density, history after image and the like in an initial stage of printing. A related art disclosed in Japanese Unexamined Patent Publication (Kokai) No. 8-240925 (corresponding to U.S. Pat. No. 5,731,122) is similarly effective for history after image (positive memory, negative memory), but has problems of lowered density in an initial stage of printing and increased fluctuation of density in continuous printing.

SUMMARY OF THE INVENTION

The present invention has been made in view of the above circumstances and provides a developing unit for electrophotographic image having a long replacement period, which can prevent the change in printing performance according to the filming with toner of the developing unit just after use at a low cost.

According to a first aspect of the present invention, there is provided a developing method for electrophotographic image for developing an electrophotographic image by use of a developing device provided with a developing mechanism having a developer carrier for conveying a developer along a preset circulating route including a developing area and a developer restricting element for restricting the developer on the developer carrier, and a developer supply mechanism having a storing means for storing the developer, wherein the developing method comprises the steps of using a start-up developer at an initial state of use of the developing mechanism; and using a replenishing developer differed in grain size or grain size distribution from the start-up developer after an end of the initial state of use of the developing mechanism.

According to a second aspect of the present invention, there is provided a developing device for electrophotographic image provided with a developing mechanism having a developer carrier for conveying a developer along a preset circulating route including a developing area and a developer restricting element for restricting the developer on the developer carrier, and a developer-supply mechanism having storing means for storing the developer, wherein the storing means is filled with a start-up developer in the vicinity of the developer carrier and a replenishing developer remoter than the start-up developer from the developer carrier, and both of the start-up developer and the replenishing developer have different grain sizes or grain size distributions.

According to a third aspect of the present invention, there is provided a printing device comprising an optical writing system for exposing a photosensitive drum to obtain a latent image, at least one developing device for visualizing the latent image on the photosensitive drum, a transfer unit for transferring the image visualized on the photosensitive drum to a sheet, and a fixing unit for fixing the image transferred to the sheet, wherein the developing device comprises a developing mechanism having a developer carrier for carrying a developer along a preset circulating route including a developing area and a developer restricting element for restricting the developer on the developer carrier, and a developer supply mechanism having storing means for storing the developer; and the storing means is filled with a start-up developer in the vicinity of the developer carrier and a replenishing developer remoter than the start-up developer from the developer carrier, and both of the start-up developer and the replenishing developer have different grain sizes or grain size distributions.

As a result of examinations, the present inventors found that when a developer (toner) is physically and electrostatically supplied from a developer recovering means (recovery roller) 4 to a developer carrier (developing roller) 3, for example, in a nonmagnetic one-component developing device as shown in FIG. 1, a selective supply of toner is performed depending on the grain size or electrification performance of the toner, or the toner with smaller diameter is basically easily supplied (developed) because of the higher specific charge, but apt to be left on the developing roller 3 because of the poorer peeling (recovery) property.

The toner left on the developing roller 3 forms a toner layer with a toner newly supplied from the recovery roller (reset roller) 4 and undergoes frictional electrification and charge injection again when it is thinned by the developer restricting element (restricting blade) 5, and is further electrified. The thus-obtained toner is varied in electrification performance, and apt to cause trouble such as variations in density within forms, after image (ghost), or lowered density in printing.

The selective development depending on the difference in electrification performance of toner is more apt to occur, particularly, in an initial stage after replacement of the developing device (developing unit, cartridge) where each member does not suffer a strong stress with the toner or the like, or as each member more clearly shows the physical and chemical characteristics derived from the constituting material thereof.

The toner physically and electrostatically supplied from the toner tank 1 or toner cartridge part (refer to 95 in FIG. 4) of the developing unit onto the developing roller 3 via the developer supply mechanism has a smaller average grain size, compared with that in the developer storing means (toner tank) 1 or toner cartridge part 95 of the developing unit, and shows a grain size distribution containing fine powders much.

This phenomenon is more obvious in the electrostatic supply from the reset roller 4 to the developing roller 3 than in the physical supply. However, when slanted to the physical supply, the stress to toner by the friction with each component is increased, and the phenomenon of increasing the toner fine powder amount by crushing consequently occurs to enhance the selective development.

Further, the reduction in printing density can be improved by preliminarily sharpening the grain size distribution of toner and reducing the fine powder amount to narrow the area of selective development. However, in the production of toner using a so-called pulverizing method, a problem such as rise of cost is caused by the deterioration of yield in a classifying process (a process for uniforming the granularity of toner).

It is also adapted to reduce the electrification performance of toner, and instead increase the supply amount according to the surface roughness of the developing roller or the circumferential speed ratio with an electrostatic latent image carrier to ensure the printing density. In this method, however, durability is deteriorated because of the increase in the stress applied to toner, and printing quality is deteriorated because of the increase in fine powder amount by crushing of toner.

Further, it is also conceivable to increase a mechanical conveying (recovering) force by enhancing the supplying (recovering) performance in toner characteristics. Although this method is generally resulted from external additives for toner, a comprehensive reexamination is required because the addition of external additives has an influence on developing, transfer, fixing, environmental resistance and the like. Further, in such a method, various side effect factors, e.g., a change over time by sinking of external additives to toner grains and an adverse effect on printing such as drop-out in development and transfer by a secondary aggregate, must be taken into consideration, and it is frequently hard to lead to a good result.

In the present invention, which could be achieved by the present inventors as a result of the earnest studies in view of various circumstances in the above-mentioned related arts, after the developing unit is manufactured, a certain characteristic difference is provided between the developer (start-up toner) to be filled in the vicinity of the developer carrier (developing roller) within the developer storing means (toner tank) and the developer (replenishing toner) to be filled remoter than the start-up developer from the developer carrier within the storing means. According to this, the difference in printing characteristics between a developing unit component having the physical and chemical characteristics derived from the constituting material and a developing unit component having the physical and chemical characteristics in the state where the surface of the developing unit component is thinly filmed with the developer can be solved to provide a developing unit showing stable printing characteristics from an initial stage of replacement (initial state of use) of the developing unit without going through a complicated test printing work, and having an extended replacement period.

According to the present inventors' examinations, differences on process as shown in Table 1 are caused between the developing unit of an unused state and the developing unit laid in a steady state where the unit component is thinly filmed with toner.

TABLE 1

| | Process Item | Unused Unit | Steady-State Unit |
|---|---|---|---|
| 1 | Electrified amount of toner on developer carrier ($\mu$C/g) | −21.56 | −15.74 |
| 2 | Toner carrying property (printing density OD) | 1.376 | 1.429 |
| 3 | Unevenness in toner carrying property (variations in printing density) | 0.014 | 0.002 |
| 4 | Toner grain size (on developer carrier) | 7.94 | 8.38 |

On the basis of the present inventors' experiences, in these differences in process characteristics, the printing using the unused unit shows the following differences in printing characteristics, compared with the printing using the steady state unit:

(1) The electrifying property to toner of each component of the developing unit is high, and the electrified amount of toner on the developing roller is consequently increased.

(2) Since the toner carried onto the developing roller is rich in highly electrifiable small-grain size toner and fine powder toner, the printing density tends to be a low value.

(3) The small-grain size toner and fine powder toner deteriorate the developing performance to the photosensitive drum (drum) because of the susceptibility to physical and electrostatic influences, and are apt to be left on the developing roller because of poor resetting performance in the recovering roller, which causes uneven electrification, uneven carrying of toner, variations in printing density, and the like.

FIG. 2 shows the relation between the toner average grain size in a toner tank and the toner grain size on a developing roller in an unused unit.

As is apparent from FIG. 2, the toner grain size on the developing roller is minimized, compared with the toner grain size in the toner tank. The difference in toner grain size is large between a printing part and a background part. These cause the unevenness in toner carrying property and variations in printing density.

According to the present inventors' examinations, such a difference in printing characteristics can be solved by independently optimizing the toner (start-up toner) in the vicinity of the developing roller in the developing mechanism (one-component developing mechanism) of an unused state and the toner (replenishing toner) in the toner tank so to be fitted to the unused developing roller and to the developing roller laid the steady state, respectively.

More specifically, the differences can be solved by applying the following methods independently or in combination:

(1) To set the grain size of the start-up toner larger than that of the replenishing toner.

(2) To set the fine powder content of the start-up toner smaller than that of the replenishing toner.

(3) To set the grain size distribution of the start-up toner narrower and sharper than that of the replenishing toner.

(4) To set the electrifying ability of the start-up toner lower than that of the replenishing toner.

The present inventors estimate the reason that the above-mentioned effect can be attained by these methods as follows.

With respect to the grain size, the larger toner grain size is effective because the influence (ratio) of the electrostatic attractive force received by toner grains is moderated more, but consideration must be taken so that the adhesion amount with the replenishing toner and the density fluctuation are not increased. The grain size distribution is desirably more sharpened in order to narrow the width of selective development, but it is necessary and sufficient in practice to limit it to the range of having no influence on printing density. For the fine powder amount, it is desirable to regulate both the number of pieces and the volume because the effect on electrification is serious.

According to the present inventors' examinations, for the grain size, the volume average grain size (DVdu) of the start-up toner is desirably set large by 0.3 to 1.2 $\mu$m when the volume average grain size (D50% Vol:DVtc) of the replenishing toner is 7.5 to 8.5 $\mu$m:

$$0.3\ \mu m \leqq Dvdu - DVtc \leqq 1.2\ \mu m$$

$$7.5\ \mu m \leqq DVtc \leqq 8.5\ \mu m$$

For the grain size distribution, the CV value (CVdu) of the start-up toner is desirably set to the CV value (CVtc) of the replenishing toner or less:

$$CVdu \leqq CVtc$$

For the fine powder amount, when the number % of the start-up toner of 5 $\mu$m or less (Ndu5.00) is Ndu and the number % of the replenishing toner of 5 $\mu$m or less (Ntc5.00) is Ntc, these are desirably set to:

$$Ndu \leqq 20.0\%$$

$$20.0\% < Ntc \leqq 25.0\%$$

Further, for the fine powder amount, when the volume % of the start-up toner of 5 $\mu$m or less (Vdu5.00) is Vdu and the volume % of the replenishing toner of 5 $\mu$m or less is Vtc, these are desirably set to:

$$Vdu \leqq 2.0\%$$

$$20.0\% < Vtc \leqq 5.0\%$$

The abovementioned grain size, grain size distribution and fine powder content were obtained by measuring the volume and number of pieces of toners of 2 $\mu$m or more by use of a 100-$\mu$m aperture by Multisizer II produced by Coulter and calculating the volume distribution and number distribution.

According to the present inventors' examinations, the filling amount of the start-up toner is preferably set to 30 g or more.

This corresponds to the toner consumption required up to the arrival to the steady state in the use of the unused unit, and naturally intended to be used to compensate this portion.

BRIEF DESCRIPTION OF THE DRAWINGS

Preferred embodiments of the present invention will be described in detail based on the followings, wherein.

DETAILED DESCRIPTION OF THE PREFERRED EMBODIMENTS

The present invention will be further described in detail according to preferred embodiments, but the present invention is not limited by the embodiments described below.

Figure 1:
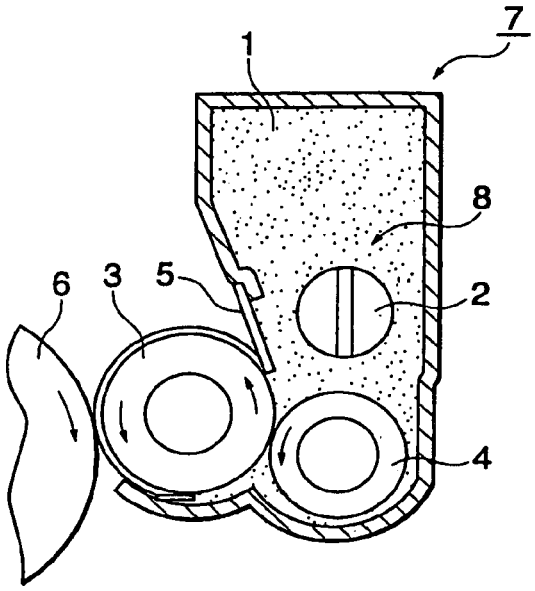
FIG. 1 PRIOR ART
FIG. 1 is a schematic view showing one example of a conventional nonmagnetic one-component developing device (developing unit)
Figure 2:
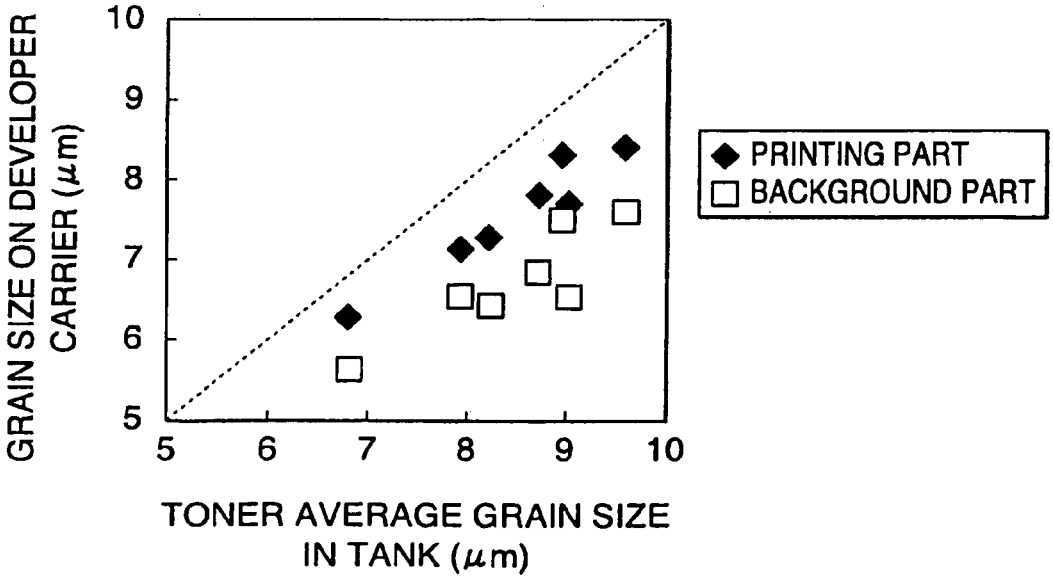
FIG. 2 is a graph showing the relation between the toner average grain size in a toner tank and the toner grain size on a developing roller in an unused unit.
Figure 3:
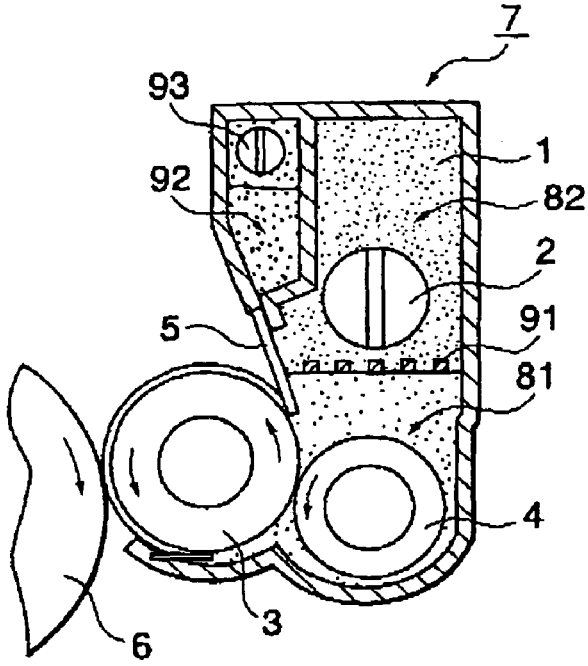
FIG. 3 is a schematic view of a nonmagnetic one-component developing device (developing unit) as an embodiment according to the present invention.

A nonmagnetic one-component developing device (developer) as one embodiment according to the present invention is schematically shown in FIG. 3. The developing unit shown in FIG. 3 corresponds to the developing unit of FIG. 1 described above, and is provided with a storing means (toner tank, etc.) 1 for storing developers (toner) 81, 82; a developer supply mechanism (stirring paddle) 2 for conveying the toner along a circulating route; a developer carrier (developing roller, etc.) 3 for conveying the toner along a preset circulating route including a developing area; and a roller-like developer recovering means (recovery roller, etc.) 4 which is provided to make contact with the developing roller 3 and has a flexible material adhered to the surface part. In the developing unit shown in FIG. 3, denoted at 81 is a start-up developer (start-up toner), 82 is a replenishing developer (replenishing toner), 92 is a waste developer recovery part (waste toner tank), and 93 is a waste developer conveying screw (waste toner conveying screw).

The developing unit is provided with a developer restricting element (restricting blade: toner restricting body) 5 for restricting the thickness of toner on the developing roller 3, and a photoconductive insulator (photosensitive drum, etc.) 6 for forming and holding an electrostatic latent image, which is arranged opposite to the developing roller 3 to be contactable thereto. The developing roller 3 is constituted so as to convey the toner supported on the developing roller 3 to the opposed photoelectric insulator 6 by rotation.

The developing unit 7 having the toner tank 1, the stirring paddle 2, the developing roller 3, the recovering roller 4 and the restricting blade 5 is replaced by a new one after printing (developing) a prescribed number of sheets.

In the toner tank 1, as is apparent from FIG. 3, the start-up toner 81 is filled in the vicinity of the developing roller 3, and the replenishing toner 82 is filled remoter than the start-up toner from the developing roller 3. Thus, a development is carried out by use of the start-up toner 81 at an initial state of use of the developing mechanism and the replenishing toner 82 after the end of the initial state of use. The start-up toner 81 and the replenishing toner 82 are constituted to have different grain sizes or grain size distributions as described later. In the embodiment shown in FIG. 3, a developer feed port (partitioning plate) 91 is provided between the start-up toner 81 and the replenishing toner 82. The partitioning plate 91 is described in detail later in reference to FIG. 8. The start-up toner 81 is preferably filled up to the partitioning plate 91, but may be filled only in the vicinity of the developing roller 3 without being filled up to the partitioning plate 91.

Figure 4:
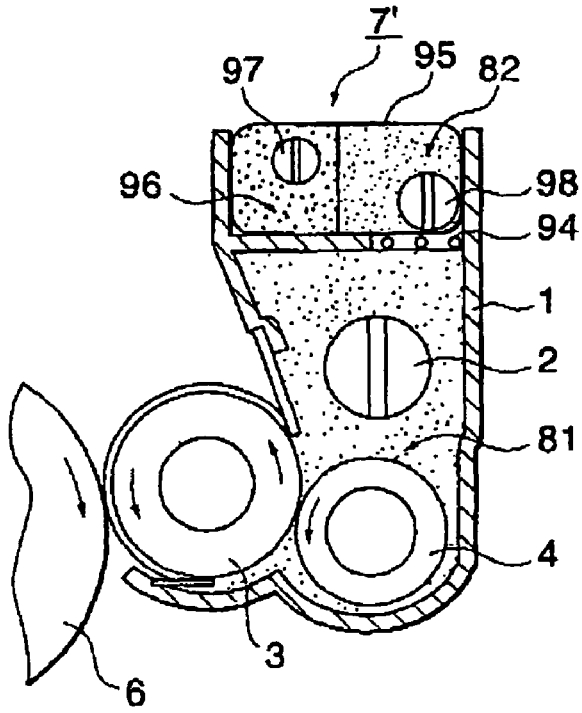
FIG. 4 is a schematic view of a nonmagnetic one-component developing device (developing unit) as another embodiment according to the present invention.

FIG. 4 is a schematic view of a nonmagnetic one-component developing device (developing unit) as another embodiment according to the present invention.

In a developing unit 7' shown in FIG. 4, the replenishing toner 82 is filled in a replaceable replenishing developer cartridge part (replenishing toner cartridge) 95. In FIG. 4, denoted at 94 is a toner feed port, 96 is a waste toner tank, 97 is a waste toner conveying screw, and 98 is a stirring paddle.

In the developing unit 7' of FIG. 4, the start-up toner 81 is fully filled up to the toner feed port 94 for supplying the replenishing toner 82 from the replenishing toner cartridge 95. However, the developing unit 7 can be filled with the start-up toner 81 only in the vicinity of the developing roller 3 and further may be provided with the partitioning plate 91 similarly to the developing unit of FIG. 3.

Figure 5:
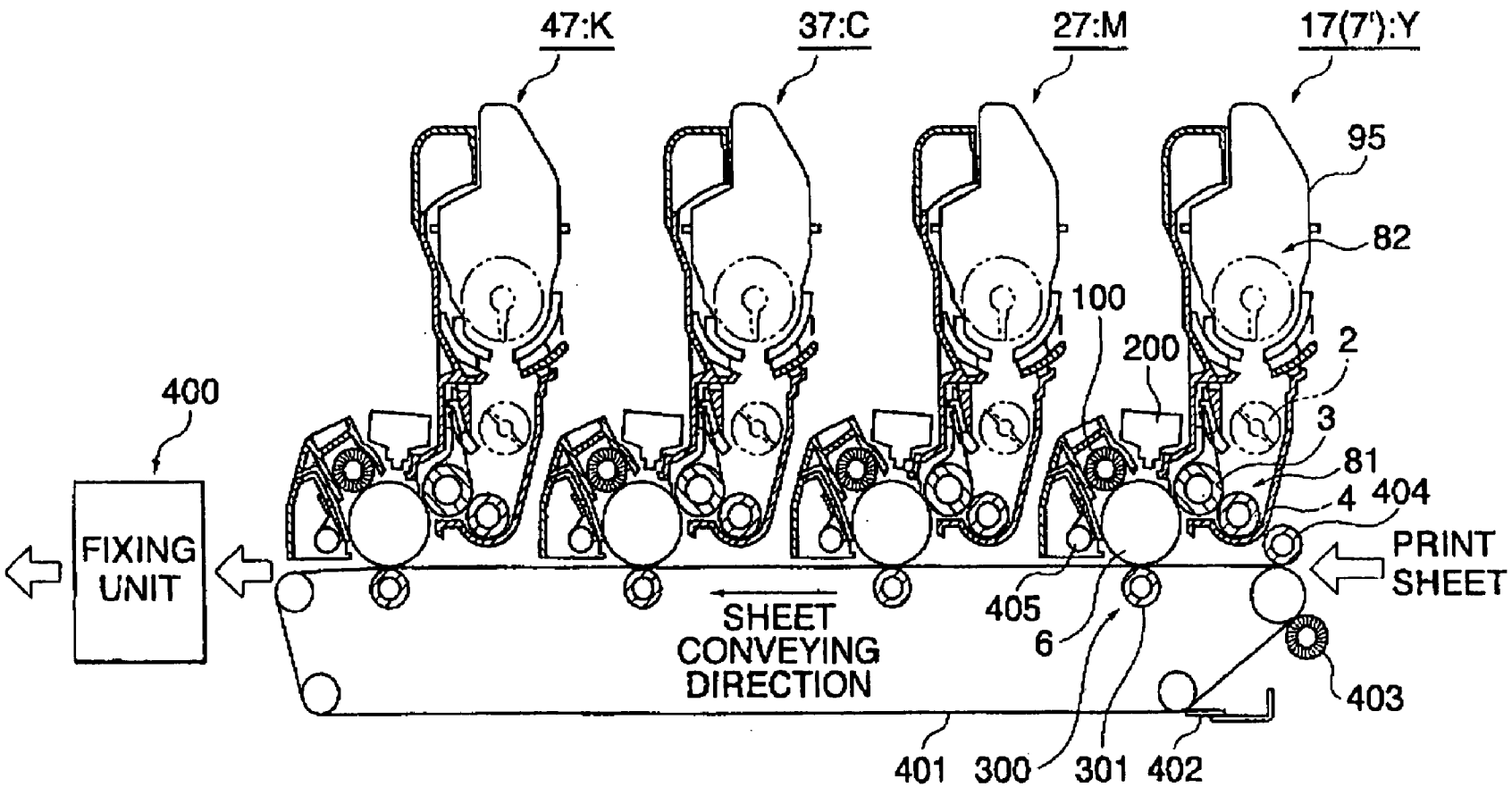
FIG. 5 is a schematic view of one example of a printing device using the developing device for electrophotographic image according to the present invention.

One example of a printing device (color printer) using the developing device for electrophotographic image according to the present invention is schematically shown in FIG. 5, wherein developing devices (developing unit) for yellow Y, magenta M, cyan C and black K are arranged in order from the upstream side from which a print sheet is conveyed, and the optical writing, development and transfer of each color of Y, M, C and K are successively performed followed by fixing, whereby a printed matter is obtained. In FIG. 5, denoted at 401 is a transfer belt, 402 is a cleaning blade 403 is a static eliminating brush, 404 is a pre-electrifying roller, and 405 is a cleaner.

Namely, in the Y-developing unit (toner cassette) 17, for example, a prescribed pattern is exposed (an electrostatic latent image is formed) to a photosensitive drum 6 electrified by an electrifying roller 100 by an optical writing system (LED optical machine) 200 to develop it (visualize the latent image) by the developing unit 17, and the toner image is transferred onto the sheet by a transfer unit 300 having a transfer roller 301. Further, the same processing is carried out for M, C and K, and all the images of Y, M, C and K are fixed, whereby the printed matter is obtained.

EXAMPLE 1

| | |
|---|---|
| Binder resin: Polyester resin (softening point 108° C.) | 91 parts by weight |
| Pigment: C. I. PIGMENT YELLOW 180 P-HG (produced by HOECHST) | 5 parts by weight |
| Charge controller: BONTRON E84 (produced by ORIENT CHEMICAL) | 2 parts by weight |
| Wax: Polypropylene Wax 550-P (produced by SANYO CHEMICAL) | 2 parts by weight |

The above compositions were mixed and stirred by use of a Henschel mixer, melted and kneaded by an extruder PCM-45 (produced by IKEGAI STEEL) heated to 140° C. followed by cooling and solidifying, then roughly pulverized by a crusher, and further finely pulverized by a jet mill. The resulting fine powder was classified by a wind classifier to obtain toner A having a center grain size of 8.3 $\mu$m and a fine powder amount of 22.2 (number %). Further, toner B having a center grain size of 8.6 $\mu$m and a fine powder amount of 7.9 (number %) was obtained by changing the operating conditions of the jet mill and wind classifier.

Toner A was filled in a toner cassette as replenishing toner, 30 g of toner B was filled in the vicinity of the developing roller (developer carrier) of a developing unit as start-up toner, and continuous printing of 1000 sheets was carried out at a printing rate of 5%. The developing roller used herein is a roller 18 mm in outer diameter having a core metal roller 10 mm in diameter lined with a conductive NBR rubber layer and an urethane coat layer applied thereon in a thickness of about several tens $\mu$m, with an axis-surface resistance of $1\times10^4$ Ω–$1\times10^7$ Ω. A GL8300A (produced by FUJITSU) remodeled machine was used for printing evaluation.

Grain size and filling quantity are proper.

As replenishing toner, Toner A described in Example 1 is used.

COMPARATIVE EXAMPLE 1

No start-up is used . . . only toner A of Example 1 is used.

TABLE 2

| | Process Item | No Start-up used | Start-up Used |
|---|---|---|---|
| 1 | Electrified amount of toner on developer carrier (μC/g) | −21.56 | −18.74 |
| 2 | Toner carrying property (printing density OD) | 1.376 | 1.408 |
| 3 | Unevenness in toner carrying property (variations in printing density) | 0.014 | 0.005 |
| 4 | Toner grain size (on developer carrier) | 7.94 | 8.38 |
| 5 | Printing density difference (OD) after printing 0 to 1000 sheets | 0.053 | 0.036 |

The variations in printing density could be suppressed by controlling the electrified amount of toner on the developing roller to a proper value by use of the start-up toner. The increase in the fine powder amount on developing roller could be suppressed to optimize the printing density, and the change with time of printing density by running could also be suppressed.

COMPARATIVE EXAMPLE 2

Grain size is smaller than regulation . . . Center grain size 8.5 μm, fine powder quantity 15.7 (number %)

TABLE 3

| | Process Item | No Start-up used | Grain size smaller than regulation |
|---|---|---|---|
| 1 | Electrified amount of toner on developer carrier (μC/g) | −21.56 | −20.25 |
| 2 | Toner carrying property (printing density OD) | 1.376 | 1.386 |
| 3 | Unevenness in toner carrying property (variations in printing density) | 0.014 | 0.007 |
| 4 | Toner grain size (on developer carrier) | 7.94 | 7.78 |
| 5 | Printing density difference (OD) after printing 0 to 1000 sheets | 0.053 | 0.037 |

The variations in printing density and the printing density difference (fluctuation) by running could be suppressed by adjusting the amount of fine powder contained in the start-up toner within the regulation of the present invention. However, problems such as poor toner carrying property and slightly lowered density in initial printing were caused, and the effect was consequently insufficient.

COMPARATIVE EXAMPLE 3

Content of small grain size is large . . . Center grain size 8.6 μm, fine powder quantity 21.2 (number %)

TABLE 4

| | Process Item | No Start-up used | Large content of small grain size |
|---|---|---|---|
| 1 | Electrified amount of toner on developer carrier (μC/g) | −21.56 | −21.86 |
| 2 | Toner carrying property (printing density OD) | 1.376 | 1.370 |
| 3 | Unevenness in toner carrying property (variations in printing density) | 0.014 | 0.015 |
| 4 | Toner grain size (on developer carrier) | 7.94 | 8.06 |
| 5 | Printing density difference (OD) after printing 0 to 1000 sheets | 0.053 | 0.053 |

When the content of small grain size (fine powder) contained in the start-up toner was out of the regulation, advantages for lowered density in initial printing, variations in printing density and printing density difference (fluctuation) were less, compared with a conventional type one using no start-up toner.

COMPARATIVE EXAMPLE 4

Grain size is larger than regulation . . . Center grain size 9.6 μm, fine powder quantity 8.9 (number %)

TABLE 5

| | Process Item | No Start-up used | Grain size larger than regulation |
|---|---|---|---|
| 1 | Electrified amount of toner on developer carrier (μC/g) | −21.56 | −18.32 |
| 2 | Toner carrying property (printing density OD) | 1.376 | 1.421 |
| 3 | Unevenness in toner carrying property (variations in printing density) | 0.014 | 0.017 |
| 4 | Toner grain size (on developer carrier) | 7.94 | 8.46 |
| 5 | Printing density difference (OD) after printing 0 to 1000 sheets | 0.053 | 0.027 |

When the toner grain size contained in the start-up toner was set larger than the regulation of the present invention, the variations in printing density within sheets were increased although the improvement in initial printing density and the suppression of the printing density difference (fluctuation) in running could be attained, and the effect was consequently insufficient.

COMPARATIVE EXAMPLE 5

Insufficient filling amount of start-up . . . 15 g of toner B used in Example 1 is filled.

TABLE 6

| | Process Item | No Start-up used | Insufficient filling amount |
|---|---|---|---|
| 1 | Electrified amount of toner on developer carrier (μC/g) | −21.56 | −18.76 |
| 2 | Toner carrying property (printing density OD) | 1.376 | 1.408 |
| 3 | Unevenness in toner carrying property (variations in printing density) | 0.014 | 0.006 |
| 4 | Toner grain size (on developer carrier) | 7.94 | 8.38 |
| 5 | Printing density difference (OD) after printing 0 to 1000 sheets | 0.053 | 0.043 |

When the filling amount of the start-up toner was insufficient, the unevenness in printing density and the printing density difference (fluctuation) by running were deteriorated more than the one containing a regulated quantity thereof. (The average toner consumption at a printing rate of 5% is 23 to 27 g/k (sheet)).

In Comparative Examples 1 to 5, the electrified amount of the start-up is desirably low, compared with the electrified amount of the replenishing toner (or the state where no start-up toner is used) and, in more detail, the obtained result shows that a value lower by 2 to 5 μC/g relative to the replenishing toner is desirable.

Figure 6:
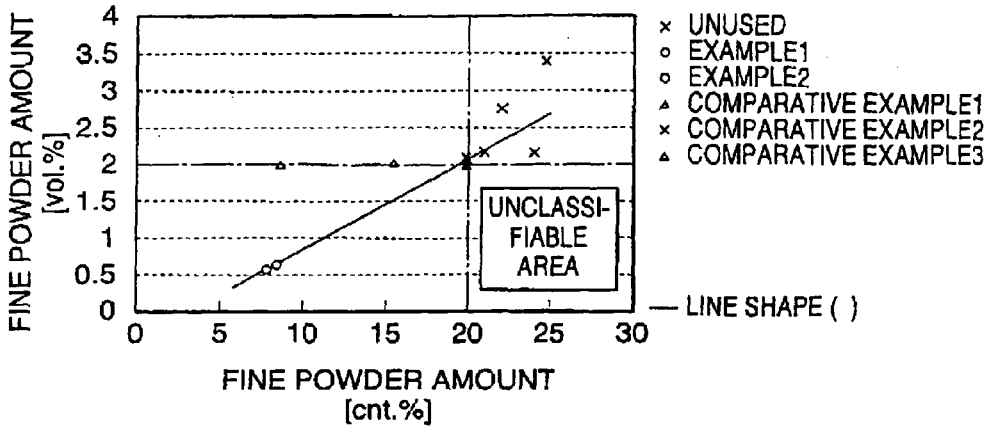
FIG. 6 is a graph showing the initial fine powder amount and evaluation result in a first example of the present invention.

The results for Example 1 are shown in Table 7 and FIG. 6.

[Table 7]

Physical Property Values and Evaluation Results for First Example and Comparative Examples The initial fine powder amount and evaluation result for the first example of the present invention is shown in FIG. 6.

As shown in FIG. 6, a suitable printing evaluation result can be obtained by reducing the fine powder amount by adjustment of classifying level. Namely, the fine powder amount is preferred to be cnt.%≦20% and vol. %≦2.0% with CVdu≦CVtc.

Figure 7:
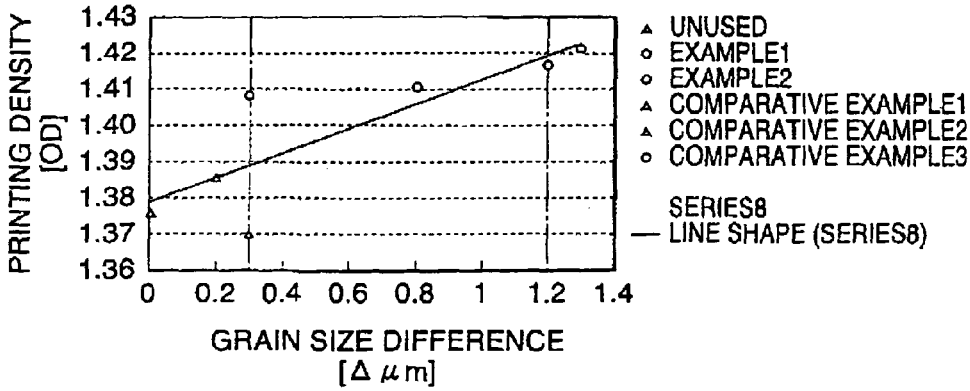
FIG. 7 is a graph showing the relation of the grain size difference between start-up toner and replenishing toner with printing density in the first example of the present invention.

The relation of the grain size difference between start-up toner and replenishing toner with printing density in the first example of the present invention is shown in FIG. 7.

As shown in FIG. 7, the larger is grain size difference between the start-up toner and the replenishing toner, the more it is suitable with respect to the printing density. Namely, 0.2≦Δμm≦1.2 is more preferable.

EXAMPLE 2

| | |
|---|---|
| Binder resin: Polyester resin (softening point 108° C.) | 93 parts by weight |
| Pigment: C. I. PIGMENT BLUE 15-3 B2G (produced by HOECHST) | 3 parts by weight |
| Electrification controlling agent: BONTRON E84 (produced by ORIENT CHEMICAL) | 2 parts by weight |
| Wax: Polypropylene wax 550-P (produced by SANYO CHEMICAL) | 2 parts by weight |

The above composites were mixed and stirred by use of a Henschel mixer, melted and kneaded by an extruder PCM-45 (produced by IKEGAI STEEL) heated to 140° C. followed by cooling and solidifying, then roughly pulverized by a crusher, and further finely pulverized by a jet mill. The resulting fine powder was classified by a wind classifier to obtain toner A having a center grain size of 8.5 μm and a fine powder amount of 21.7 (number %). Further, toner B having a center grain size of 8.8 μm and a fine powder amount of 8.9 (number %) was obtained by changing the operating conditions of the jet mill and the wind classifier.

TABLE 7

Physical Property Values and Evaluation Results for First Example and Comparative Examples

| | | Unused | | Ex. 1 | | Ex. 2 | | Comp. Ex. 1 | | Comp. Ex. 2 | | Comp. Ex. 3 | |
|---|---|---|---|---|---|---|---|---|---|---|---|---|---|
| Physical values: | Center grain size | 8.3 | Improper | 8.6 | Proper | 9.5 | Proper | 8.5 | Improper | 8.6 | Proper | 9.6 | Improper |
| | Fine powder amount cnt. % | 22.2 | Proper | 7.9 | Proper | 8.6 | Proper | 15.7 | Proper | 21.2 | Improper | 8.9 | Proper |
| | Fine powder amount vol. % | 2.75 | Improper | 0.59 | Proper | 0.64 | Proper | 2.04 | Improper | 2.17 | Improper | 1.12 | Proper |
| Evaluation items: | Electrified amount of toner | −21.56 | ○ | −18.74 | ◎ | −18.63 | ◎ | −20.25 | ○ | −21.86 | ○ | −18.32 | ◎ |
| | Printing density | 1.376 | ○ | 1.408 | ◎ | 1.417 | ◎ | 1.386 | ○ | 1.37 | ○ | 1.421 | ◎ |
| | Unevenness in density | 0.014 | x | 0.005 | ◎ | 0.005 | ◎ | 0.007 | ○ | 0.015 | x | 0.017 | x |
| | Short running | 0.053 | x | 0.036 | ◎ | 0.03 | ◎ | 0.037 | ◎ | 0.053 | x | 0.027 | ◎ |
| Comment: | Grain size (on roller) | 7.94 | ○ | 8.38 | ◎ | 8.76 | ○ | 7.78 | ○ | 8.06 | ○ | 8.46 | x |

Evaluation items
◎ Suitable
○ Proper
x Improper

Toner A was filled in a toner cassette, and 30 g of toner B was filled in the vicinity of the developing roller (developer carrier) of a developing unit as start-up toner, and a continuous printing of 1000 sheets was carried out at a printing rate of 5%. The developing roller used herein is a roller 18 mm in outer diameter having a core metal roller 10 mm in diameter lined with a conductive NBR rubber layer and an urethane coat layer applied thereon in a thickness of about several tens μm, with an axis-surface resistance of $1\times10^4$ Ω–$1\times10^7$ Ω. A GL8300A (produced by FUJITSU) remodeled machine was used for printing evaluation.

COMPARATIVE EXAMPLE 6

No start-up is used . . . only toner A of Example 2 is used

TABLE 8

| | Process Item | No Start-up used | Start-up used |
|---|---|---|---|
| 1 | Electrified amount of toner on developer carrier (μC/g) | −21.23 | −19.21 |
| 2 | Toner carrying property (printing density OD) | 1.366 | 1.405 |
| 3 | Unevenness in toner carrying property (variations in printing density) | 0.014 | 0.005 |
| 4 | Toner grain size (on developer carrier) | 7.88 | 8.21 |
| 5 | Printing density difference (OD) after printing 0 to 1000 sheets | 0.051 | 0.035 |

The unevenness in toner carrying property could be suppressed by controlling the electrified amount of toner on developing roller to a proper value by use of the start-up toner. The increase in the fine powder amount on developing roller could also be suppressed to optimize the printing density, and the change with time in printing density by running could be further suppressed.

EXAMPLE 3

| | |
|---|---|
| Binder resin: Polyester resin (softening point 108° C.) | 92 parts by weight |
| Pigment: PIGMENT RED 184 F6B (produced by HOECHST) | 4 parts by weight |
| Electrification controlling agent: BONTRON E84 (produced by ORIENT CHEMICAL) | 2 parts by weight |
| Wax: Polypropylene wax 550-P (produced by SANYO CHEMICAL) | 2 parts by weight |

The above composites were mixed and stirred by use of a Henschel mixer, melted and kneaded by an extruder PCM-45 (produced by IKEGAI STEEL) heated to 140° C. followed by cooling and solidifying, then roughly pulverized by a crusher, and further finely pulverized by a jet mill. The resulting fine powder was classified by a wind classifier to obtain toner A having a center grain size of 8.5 μm and a fine powder amount of 23.76 (number %). Further, toner B having a center grain size of 8.8 μm and a fine powder amount of 9.3 (number %) was obtained by changing the operating conditions of the jet mill and the wind classifier.

Toner A was filled in a toner cassette, and 30 g of toner B was filled in the vicinity of the developing roller (developer carrier) of a developing unit as start-up toner, and a continuous printing of 1000 sheets was carried out at a printing rate of 5%. The developing roller used herein is a roller 18 mm in outer diameter having a core metal roller 10 mm in diameter lined with a conductive NBR rubber layer and an urethane coat layer applied thereon in a thickness of about several tens μm, with an axis-surface resistance of $1\times10^4$ Ω–$1\times10^7$ Ω. A GL8300A (produced by FUJITSU) remodeled machine was used for printing evaluation.

COMPARATIVE EXAMPLE 7

No start-up is used . . . Only toner A of Example 3 is used

TABLE 9

| | Process Item | No Start-up used | Start-up used |
|---|---|---|---|
| 1 | Electrified amount of toner on developer carrier (μC/g) | −23.23 | −19.34 |
| 2 | Toner carrying property (printing density OD | 1.362 | 1.407 |
| 3 | Unevenness in toner carrying property (variations in printing density) | 0.014 | 0.005 |
| 4 | Toner grain size (on developer carrier) | 7.86 | 8.13 |
| 5 | Printing density difference (OD) after printing 0 to 1000 sheets | 0.054 | 0.031 |

The variations in printing density could be suppressed by controlling the electrified amount of toner on developing roller to a proper value by use of the start-up toner. The increase in the fine powder amount on developing roller could also be suppressed to optimize the printing density, and the change with time in printing density by running could be further suppressed.

With respect to the shape of the partitioning plate used between the replenishing toner part and the start-up toner part, the present invention is further described in more detail by use of an embodiment, but the present invention is not limited thereby.

EXAMPLE 4

Figure 8A:
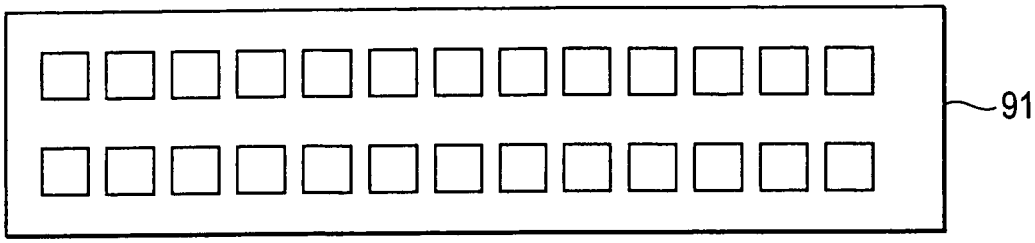
FIGS. 8A, 8B and 8C are views showing examples of the shape of toner feed port.
Figure 8B:
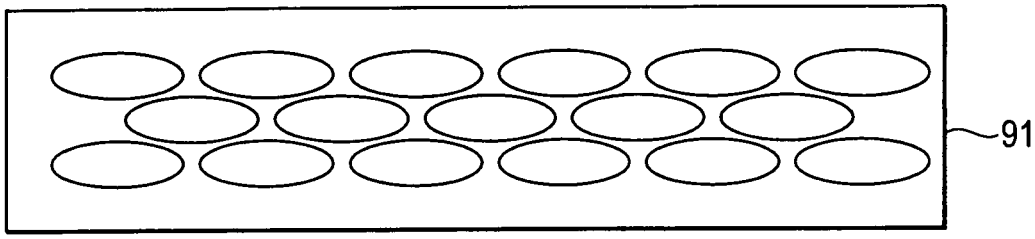
Figure 8C:
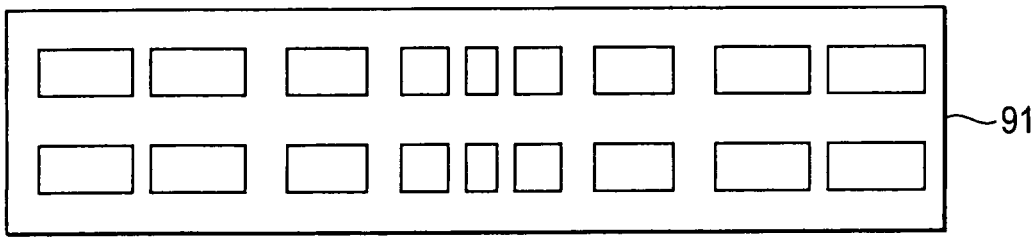

FIGS. 8A, 8B and 8C show examples of the shape of a developer feed port (partitioning plate), wherein the partitioning plate has square toner replenishing openings (slit) (BA), elliptic toner replenishing openings (8B), and toner replenishing openings varied in size depending on position (8C). The toner replenishing openings in the partitioning plate of FIG. 8A occupy about 50% of the area of the partitioning plate, and the partitioning plate in the partitioning plate of FIG. 8B has a ratio of toner replenishing openings to the area of the partitioning plate sufficiently larger than in the partitioning plate of FIG. 8A.

In the partitioning plate of FIG. 8C, for example, the size of the toner replenishing openings just under the stirring paddle 2 in the developing unit of FIG. 3 is set small, and the size of the toner replenishing openings located remoter from the stirring paddle 2 is set large, so that the start-up toner and the replenishing toner can be mixed without being affected by the stirring paddle 2. As the shape of the partitioning plate 91, various shapes can be adapted in addition to those shown in FIGS. 8A to 8C.

As shown in FIG. 8A, the developer feed port (the partitioning plate 91 in FIG. 3) includes 5 mm×5 mm square slits provided by about 50% of the area of the partitioning plate. The partitioning plate 91 shown in FIG. 8A was applied to the replenishing toner A, the start-up toner B, and the developing roller, and continuous printing of 1000 sheets was carried out at a printing rate 5% by a GL8300A (produced by FUJITSU) printer. (The toner B was replenished from the toner cartridge by 100 g each every 3000 sheets.)

Effect

Figure 9:
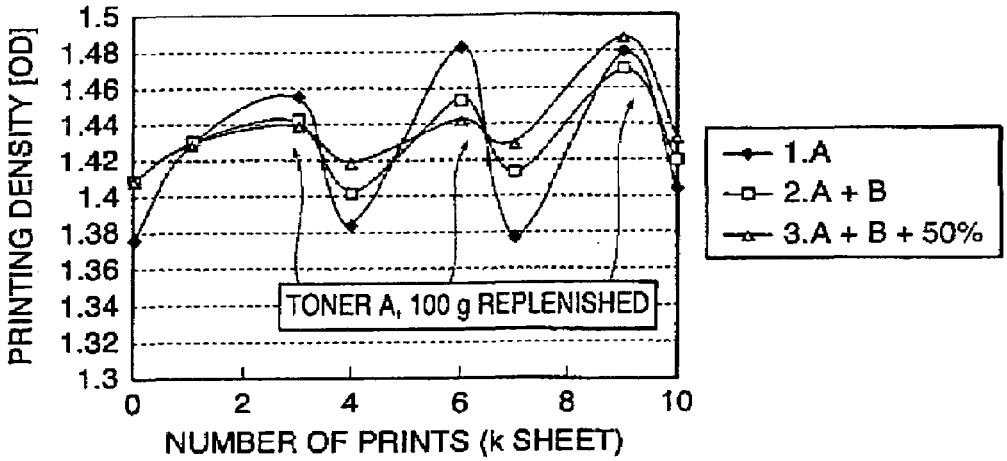
FIG. 9 is a graph showing the relation of the grain size difference between start-up toner and replenishing toner with printing density in the developing device of one embodiment of the present invention.

The relation of the grain size difference between start-up toner and replenishing toner with printing density in the developing device of one embodiment of the present invention is shown in FIG. 9.

In FIG. 9, (1) shows the user of only toner A, (2) shows the use of toner A and start-up toner B, and (3) shows the combined use of toner A and start-up toner B with the partitioning plate 91.

As is apparent from FIG. 9, when the use of only toner A (1) is compared with the combined use of toner A and start-up toner B (2), the fluctuation of printing density before and after replenishing of toner is large in (1). This conceivably results from the fluctuation of various physical properties such as toner grain size on the developing roller before and after replenishing of toner by the effect of the selective development.

Further, when the use of toner A and start-up toner B (2) is compared with the combined use of toner A and start-up toner B with the partitioning plate 91 of FIG. 8A (3), the fluctuation of toner density seems smaller in (3) where the partitioning plate is provided. This conceivably results from the suppression of fluctuation of physical properties by sudden mixing of the replenishing toner with the residual toner in the developing unit by the partitioning plate.

TABLE 10

Slit Open Area Ratio and Printing Density Fluctuation

| Open area ratio (%) | Density fluctuation (3 k to 4 k) | Density fluctuation (6 k to 7 k) | Density fluctuation (9 k to 10 k) |
|---|---|---|---|
| 30 | 0.032 | 0.031 | 0.053 |
| 40 | 0.031 | 0.025 | 0.051 |
| 50 | 0.026 | 0.016 | 0.055 |
| 100 | 0.041 | 0.041 | 0.050 |

As shown in Table 10, the smaller the open area ratio is, the more the density fluctuation after replenishing can be suppressed. However, since the follow-up property at a high printing rate is deteriorated, 40% where a substantial difference hardly occurs in fluctuating quantity is considered a lower limit value. For the upper limit, a higher open area ratio cannot be an obstacle to printing, but the effect to density fluctuation is varnished.

Namely, for the slit open area ratio, slit plates as shown in FIG. 8A and FIG. 8B are usable.

(Grain Size Distribution of Toner)

The average grain size and grain size distribution of toner can be measured by various methods such as Coulter Counter TA-II, Coulter Multisizer (produced by Coulter). In the present invention, Multisizer II (produced by Coulter) was used, an interface (produced by NIKKAKI) for outputting a number distribution and a volume distribution was connected to a PC 9801 personal computer (produced by NEC), and 1% NaCl aqueous solution was prepared as electrolyte by use of primary sodium chloride. At that time, ISOTON-II (produced by Coulter SCIENTIFIC JAPAN) was usable. In measurement, a surface active agent, preferably, 0.1 to 5 ml of an alkylbenzene sulfonated was added as dispersant to 100 to 150 ml of the electrolytic aqueous solution, and 2 to 20 mg of a measuring sample was further added thereto. The electrolyte with the sample suspended therein was subjected to dispersing treatment for about 1 to 3 minutes by an ultrasonic dispersing apparatus, and the volume and number of toners of 2 $\mu$m or more were measured by use of a 100-$\mu$m aperture as aperture by Multisizer II to calculate the volume dispersion and number dispersion. Thereafter, the volume average grain size of a volume reference determined from the volume distribution according to the present invention, the rough powder quantity (12.7 $\mu$m or more) of the volume reference determined from the volume distribution, and the fine powder amount (5 $\mu$m or less) of a number reference determined from the number distribution were determined.

(Electrified Amount of Toner)

An E-spart analyzer E-SPART-2 (produced by HOSOKAWA MICRON) was used for measurement of the electrified amount of toner. With respect to the toner on a roller in the developing state of a GL8300A (produced by FUJITSU) printer, measurement of about 3000 pieces was carried out under conditions of gas pressure: 0.4 kgf/cm$^2$ and field voltage: 150 V.

(Constituting Materials of Toner)

To the present invention, all known preparing processes and materials are applicable.

Examples of the binder resin include polymers of styrene and substituted bodies thereof such as polystyrene, poly p-chlorostyrene, and polyvinyl toluene; styrene-based copolymers such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-$\alpha$-chloro methyl methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic resin, rosin, denatured rosin, terpene resin, aliphatic or alicyclic hydrocarbon resin, aromatic petroleum resin, chlorinated paraffin, and paraffin wax, and these may be used alone or in combination.

As the coloring agent, all known dyes and pigments are usable. Examples thereof include carbon black, nigrosine dye, iron black, naphthol yellow S, Hansa yellow (10G, 5G, G9), cadmium yellow, yellow iron oxide, Chinese yellow, chrome yellow, titanium yellow, polyazo yellow, oil yellow, Hansa yellow (GR, A, RN, R), pigment yellow L, benzine yellow (G, GR), permanent yellow (NCG), Vulcan fast yellow (5G, R), tartrazine lake, quinoline yellow lake, anthrazane yellow BGL, isoindolinone yellow, colcothar, minium, vermilion lead, cadmium red, cadmium mercury red, antimony red, permanent red 4R, para red, fire red, parachloro orthonitroaniline red, lithol fast scarlet red G, brilliant fast scarlet red, brilliant carmine BS, permanent red (F2R, F4R, FRL, FRLL, F4RH), fast scarlet VD, Vulcan fast rubin B, brilliant scarlet G, lithol rubin GX, permanent red F5R, brilliant carmine 6B, pigment scarlet 3B, Bordeaux 5B, toluidine maroon, permanent Bordeaux F2K, helio Bordeaux BL, Bordeaux 10B, BON maroon light, BON maroon medium, eosin lake, rhodamine lake B, rhordamine lake Y, alizarin lake, thio indigo red B, thio indigo maroon, oil red, quinacridone red, pyrazolone red, poly azo red, chrome vermilion, benzyl orange, perynone orange, oil orange, cobalt blue, cerulean blue, alkali blue lake, peacock blue lake, Victoria blue lake, nonmetal phthalocyanine blue, phthalocyanine blue, fast sky blue, indanthrene blue (RS, BC), indigo, ultramarine blue, iron blue, anthraquinone blue, fast violet B, methyl violet lake, cobalt violet, manganese violet, dioxane violet, anthraquinone violet, chrome green, zinc green, chromium oxide, pyridiane, emerald green, pigment green B, naphthol green B, green gold, acid green lake, malachite green lake, phthalocyanine green, anthraquinone green, titanium oxide, zinc white, lithopone, and mixtures thereof. The using amount is generally set to 1 to 50 parts by weight to 100 parts by weight of the binder resin.

The developer used in the present invention may contain an electrification controlling agent as occasion demands. As the electrification controlling agent, all known ones are usable, including, for example, nigrosine dyes, triphenyl methane-based dyes, chrome-containing metal complex dyes, molybdic acid chelate pigments, rhodamine-based dyes, alkoxy-based amines, ternary ammonium salts (including fluorine modified ternary ammonium salt), alkylamides, single body of phosphor or compounds thereof, single body of tungsten or compounds thereof, fluorine-based activators, salicylic metal salts, metal salts of salicylic derivatives, and the like. Concrete examples thereof include BONTRON 03 of nigrosine dye, BONTRON P-51 of ternary ammonium salt, BONTRON S-34 of metal-containing azo dye, E-82 of oxy naphthoatic acid-based metal complex, D-84 of salicylic acid-based metal complex, and E-89 of phenolic condensate (produced by ORIENT CHEMICAL); TP-302 and TP-415 of ternary ammonium salt molybdenum complex (produced by HODOGAYA CHEMICAL); COPY CHARGE PSY VP2038 of ternary ammonium salt, COPY BLUE PR of triphenyl methane derivative, COPY CHARGE NEG VP2036 of ternary ammonium salt, COPY CHARGE NX, and VP434 (produced by HOECHST); LRA-901 and LR-147 of boron complex (produced by NIPPON CARLIT); copper phthalocyanine, perylene, quinacridone, and azo pigments; and other polymer compounds having a functional group such as sulfonic group, carboxyl group, ternary ammonium salt or the like.

The using amount of the electrification controlling agent in the present invention is determined depending on the preparation method of toner including the kind of binder resins, the presence or absence of additives used as occasion demands, and dispersing method without being unitarily limited. However, the agent is used preferably in the range of 0.1 to 10 parts by weight to 100 parts by weight of the binder resin, more preferably, in the range of 2 to 5 parts by weight. When it exceeds 10 parts by weight, the excessively enhanced electrifying property of toner deteriorates the effect of the main electrification controlling agent to increase the electrostatic attractive force with the developing roller, causing a reduction in flow characteristic of the developer or a reduction in image density.

To impart releasability to the developer to be produced, a wax is desirably included in the developer to be produced. The wax has a melting point of 40 to 120° C., preferably, 50 to 110° C. When the melting point of the wax is excessive, the fixing performance at a low temperature is often insufficient, and when the melting point is too low, offset resistance and durability may be deteriorated. The melting point of the wax can be determined by differential scanning calorimetry (DSC). Namely, the melting peak value in the heating of several milligrams of a sample at a fixed temperature rise rate, for example, 10° C./min is taken as the melting point.

Examples of the wax usable in the present invention include solid paraffin wax, micro wax, rice wax, fatty acid amide-based wax, fatty acid-based wax, aliphatic monoketone, fatty acid metal salt-based wax, fatty acid ester-based wax, partially saponified fatty acid ester-based wax, silicone varnish, higher alcohol, carnava wax, and the like. Polyolefins such as low molecular weight polyethylene and polypropylene are also usable. Particularly, a polyolefin having a softening point of 70 to 150° C. by ball and ring method is preferable, and a polyolefin having a softening point of 120 to 150° C. is further preferable.

As external additives, inorganic fine particles are preferably used. The primary particle size of the inorganic fine particles is preferably 5 nm to 2 $\mu$m and, particularly preferably, 5 nm to 500 nm. The specific surface area by BET method is preferably 20 to 500 $m^2/g$. The using ratio of the organic fine particles is preferably set to 0.01 to 5 wt % of the toner and, particularly preferably, 0.01 to 2.0 wt %. Concrete examples of the inorganic fine particles include silica, alumina, titanium oxide, barium titanate, magnesium titanate, calcium titanate, strontium titanate, zinc oxide, tin oxide, silica sand, clay, mica, tabular spar, diatomaceous earth, chromium oxide, cerium oxide, red iron oxide, antimony trioxide, magnesium oxide, zirconium oxide, barium sulfate, barium carbonate, calcium carbonate, silicon carbonate, silicon nitride, and the like.

In addition to the above, polymer fine particles, for example, polymer polystyrene, methacrylate and acrylate copolymers obtained by soap-free emulsification polymerization, suspension polymerization, or dispersion polymerization; polycondensed ones such as silicone, benzoguanamine and nylon, and polymer particles by thermosetting resin are usable.

Such a fluidizing agent is subjected to surface treatment to enhance water resistance, whereby deterioration of flowing characteristic or electrification characteristic can be prevented even under high humidity. Preferred surface treatment agents therefor, for example, include a silane coupling agent, a silylizing agent, a silane coupling agent having a fluorinated alkyl group, an organic titanate-based coupling agent, an aluminum-based coupling agent and the like.

Cleaning performance improving agents for removing the developer after transfer left on a photoreceptor or primary transfer medium include a fatty acid metal salt such as zinc stearate, calcium stearate, or stearic acid, a polymer fine particle produced by soap-free emulsification polymerization such as polymethyl methacrylate fine particle or polystyrene fine particle, and the like. The polymer fine particle preferably has a relatively narrow grain size distribution and a volume average particle size of 0.01 to 1 $\mu$m.

The nonmagnetic one-component developing method and developing device using nonmagnetic one-component developers were mainly described in the above. However, the present invention is not limited to the ones using the nonmagnetic one-component developers, and can be extensively applied to electrophotographic image developments for obtaining electrophotographic images by use of various developers.

Many different embodiments of the present invention may be constructed without departing from the spirit and scope of the present invention, and it should be understood that the present invention is not limited to the specific embodiments described in this specification, except as defined in the appended claims.

What is claimed is:

1. A developing method for developing an electrophotographic image by use of a developing device comprising a developing mechanism having a developer carrier for carrying a developer along a preset circulating route including a developing area and a developer restricting element for restricting the developer on the developer carrier, and a developer supply mechanism having storing means for the developer, wherein said developing method comprises the steps of:

using a start-up developer at an initial state of use of the developing mechanism; and using a replenishing developer differed in grain size or grain size distribution from the start-up developer after an end of the initial state of use of the developing mechanism, wherein, when number percentage of a fine powder component of 5 $\mu$m or less in the start-up developer is Ndu and number percentage of a fine powder component of 5 $\mu$m or less in the replenishing developer is Ntc, the grain size distributions of the start-up developer and replenishing developer satisfy the following relational expressions:

$$Ndu \leqq 20.0\%, \text{ and } 20.0\% < Ntc \leqq 25.0\%.$$

2. The developing method for an electrophotographic image according to claim 1, wherein, when a volume average grain size of the start-up developer is DVdu and a volume average grain size of the replenishing developer DVtc, the volume average grain sizes of the start-up developer and replenishing developer satisfy the following relational expressions:

$$0.3\,\mu m \leqq DVdu - DVtc \leqq 1.2\,\mu m, \text{ and } 7.5\,\mu m \leqq DVtc \leqq 8.5\,\mu m.$$

3. The developing method for an electrophotographic image according to claim 1, wherein the developer is a nonmagnetic one-component developer, and the developing method is applied to a nonmagnetic one-component image developing device.

4. A developing method for developing an electrophotographic image by use of a developing device comprising a developing mechanism having a developer carrier for carrying a developer along a preset circulating route including a developing area and a developer restricting element for restricting the developer on the developer carrier, and a developer supply mechanism having storing means for the developer, wherein said developing method comprises the steps of:

using a start-up developer at an initial state of use of the developing mechanism; and using a replenishing developer differed in grain size or grain size distribution from the start-up developer after an end of the initial state of use of the developing mechanism, wherein when volume percentage of a fine powder component of 5 $\mu$m or less in the start-up developer is Vdu and volume percentage of a fine powder component of 5 $\mu$m or less in the replenishing developer is Vtc, the grain size distributions of the start-up developer and replenishing developer satisfy the following relational expressions:

$$Vdu \leqq 2.0\% \text{ and } 2.0\% < Vtc \leqq 5.0\%.$$

5. The developing method for an electrophotographic image according to claim 4, wherein, when a volume average grain size of the start-up developer is DVdu and a volume average grain size of the replenishing developer DVtc, the volume average grain sizes of the start-up developer and replenishing developer satisfy the following relational expressions:

$$0.3\,\mu m \leqq DVdu - DVtc \leqq 1.2\,\mu m, \text{ and } 7.5\,\mu m \leqq DVtc \leqq 8.5\,\mu m.$$

6. The developing method for an electrophotographic image according to claim 4, wherein the developer is a nonmagnetic one-component developer, and the developing method is applied to a nonmagnetic one-component image developing device.

* * * * *